US005540968A

United States Patent [19]

Higgins

[11] Patent Number: 5,540,968

[45] Date of Patent: Jul. 30, 1996

[54] CUSHIONED BACKED CARPET TILE WITH STABILIZED NONWOVEN BACKING

[75] Inventor: Kenneth B. Higgins, LaGrange, Ga.

[73] Assignee: Milliken Research Corporation, Spartanburg, S.C.

[21] Appl. No.: 312,817

[22] Filed: Sep. 27, 1994

Related U.S. Application Data

[63] Continuation-in-part of Ser. No. 205,834, Mar. 3, 1994.

[51] Int. Cl.[6] ..... B32B 3/02; D04H 1/58; D04H 1/04

[52] U.S. Cl. ..... 428/95; 428/288; 428/296; 156/72

[58] Field of Search ..... 428/95, 288, 296; 156/72

[56] References Cited

U.S. PATENT DOCUMENTS

| | | | |
|---|---|---|---|
| 3,887,738 | 6/1975 | Taft et al. | 428/95 |
| 3,926,700 | 12/1975 | Hopkins, Jr. et al. | 428/95 |
| 3,982,051 | 9/1976 | Taft et al. | 428/95 |
| 4,132,817 | 1/1979 | Tillotson | 427/244 |
| 4,171,395 | 10/1979 | Tillotson | 428/95 |
| 4,405,393 | 9/1983 | Tillotson | 156/78 |
| 4,512,831 | 4/1985 | Tillotson | 156/78 |
| 4,522,857 | 6/1985 | Higgins | 428/95 |
| 4,576,665 | 3/1986 | Machell | 156/72 |
| 4,647,484 | 3/1987 | Higgins | 428/95 |
| 4,696,849 | 9/1987 | Mobley et al. | 428/95 |
| 4,770,916 | 9/1988 | Leukel et al. | 428/95 |
| 4,798,644 | 1/1989 | Scott et al. | 428/95 |
| 4,822,658 | 4/1989 | Pacione | 428/95 |
| 4,824,498 | 4/1989 | Goodwin et al. | 428/95 |
| 4,842,915 | 6/1989 | Hartmann et al. | 428/95 |
| 4,865,688 | 9/1989 | Cross et al. | 428/95 |
| 5,030,497 | 7/1991 | Claessen | 428/95 |
| 5,077,874 | 1/1992 | Trask et al. | 428/95 |
| 5,204,155 | 4/1993 | Bell et al. | 428/95 |

FOREIGN PATENT DOCUMENTS

| | | | |
|---|---|---|---|
| 0268875 | 11/1987 | European Pat. Off. | D06N 7/00 |
| 247654 | 10/1989 | Japan | E04F 15/16 |
| 2256614 | 12/1992 | United Kingdom | D06N 7/00 |
| WO87/01656 | 3/1987 | WIPO | B32B 27/40 |

*Primary Examiner*—Terrel Morris
*Attorney, Agent, or Firm*—Terry T. Moyer; James M. Robertson

[57] ABSTRACT

A cushioned carpet tile is provided. The cushioned carpet tile includes a primary carpet fabric having a plurality of pile-forming yarns projecting from one side thereof. A mass of polymer cushioning is dispersed on the side of the primary carpet fabric from which the pile-forming yarns do not extend. A heat-fused nonwoven backing of polyester and polypropylene is disposed on the bottom of the polymer cushioning. The ratio of polyester to polypropylene in the nonwoven backing is between about 0.43 and about 2.3.

14 Claims, 3 Drawing Sheets

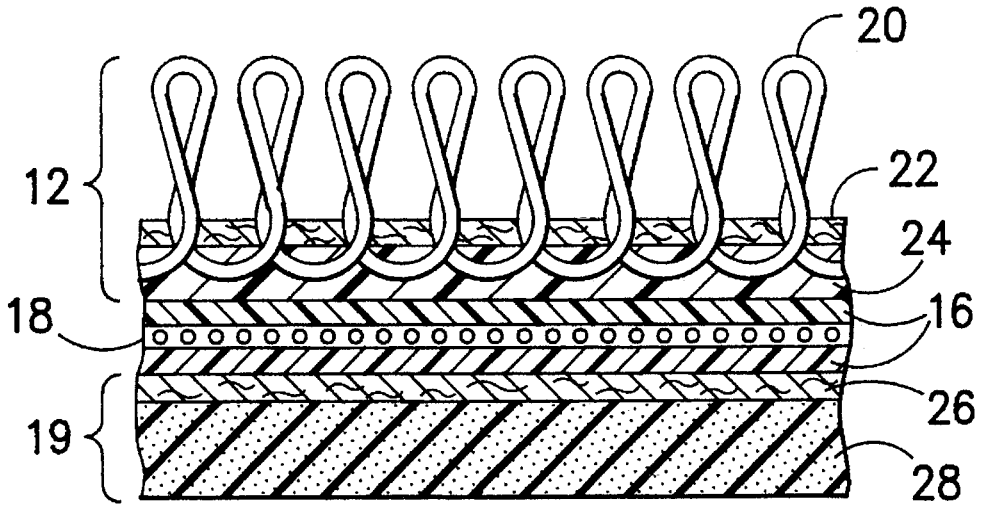
FIG. —1A—
PRIOR ART
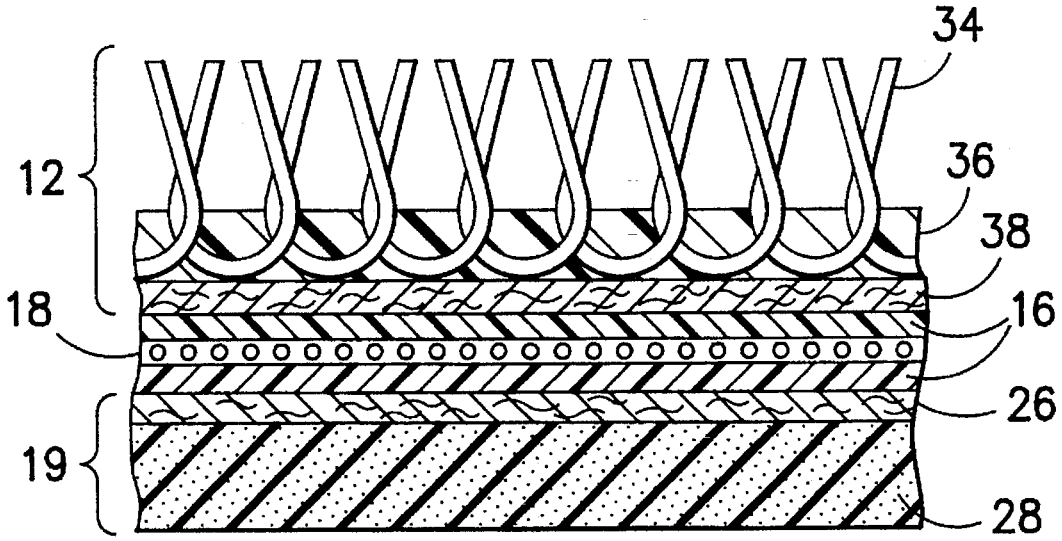
FIG. —1B—
PRIOR ART

CUSHIONED BACKED CARPET TILE WITH STABILIZED NONWOVEN BACKING

CROSS REFERENCE TO RELATED APPLICATION

This application is a Continuation-in-Part of my pending application number 08/205,834 filed Mar. 3, 1994 entitled "Cushioned Backed Carpet" which is incorporated herein by reference.

FIELD OF THE INVENTION

The present invention relates to cushion backed carpet tile and more particularly to carpet tile having a polymer cushion with a stable nonwoven backing material including a composite of polyester and polypropylene on the rear (i.e. floor-contacting) side of the tile.

BACKGROUND OF THE INVENTION

Carpet and carpet tiles having cushioned backings are well known to those of skill in the art. Such cushioned backed carpet is disclosed, for example in my U.S. Pat. No. 4,522,857 (incorporated by reference). An example of a prior art tufted carpet product is illustrated in FIG. 1A and an example of a prior art bonded carpet product is illustrated in FIG. 1B herein.

In the prior art tufted carpet, a primary carpet fabric 12 is embedded in an adhesive layer 16 in which is embedded a layer of glass scrim or nonwoven material. A foam base composite 19 is likewise adhesively bonded to the adhesive layer 16. In the prior art tufted carpet illustrated in FIG. 1A, the primary carpet fabric 12 includes a loop pile layer 20 tufted through a primary backing 22 by a conventional tufting process and held in place by a precoat backing layer of latex 24 or other appropriate adhesive including a hot melt adhesive or the like. The foam base composite 19 of the prior art tufted carpet product preferably includes an intermediate layer 26 molded to a layer of urethane foam 28 as illustrated.

The bonded carpet product (FIG. 1B) formed according to the prior art employs the same type of foam base composite 19 adhesively bonded by adhesive laminate layers 16. However, the primary carpet fabric 12 has somewhat different components from that of the tufted product in that it preferably comprises cut pile yarns 34 implanted in a PVC, latex, or hot melt adhesive 36 having a woven or nonwoven reinforcement or substrate layer 38 of fiberglass, nylon, polypropylene or polyester.

In the potentially preferred embodiment of the present invention, a puddle of polyurethane-forming composition is deposited across a nonwoven needlepunched backing material of polyester and polypropylene. A primary carpet fabric which may include a glass reinforcement material bonded thereto is brought together with the polyurethane-forming puddle. The entire structure is then heated to cure the polyurethane forming composition.

It has been determined that through proper control of the composition of the nonwoven backing that significant advantages in heat shrinkage and mechanical stability can be achieved while at the same time giving rise to a smooth flooring contact surface which is of benefit in some installation practices where carpet tile must be maneuvered into position by sliding across a flooring surface or where a peel-away adhesive sheet or pre-applied pressure sensitive adhesive is to be used.

As will be appreciated by those of skill in the art, the production and subsequent patterning of carpet tiles may necessitate the exposure of the carpet structure to elevated temperatures for significant periods of time. By way of example, a carpet composite may undergo post-cure heating at temperatures between 250° F. and 325° F. for between about 2 minutes and 8 minutes. The subjection of the carpet to these types of temperatures requires that the backing material be resistant to unreasonable heat shrinkage which can lead to cupping of a carpet tile as well as being resistant to stretching which can lead to curling of a carpet tile.

At the same time, it is desirable to be able to fuse the fibers on the floor contacting surface of the backing material with heat to provide a smooth contacting surface. While some cupping yielding a slightly domed configuration to the tile may be acceptable and, in fact, desirable in some instances, curling is unacceptable in that it gives rise to numerous process disadvantages including difficulty in patterning in later stages. Prior to the present invention it was believed that a nonwoven backing containing 80 percent polyester and 20 percent polypropylene would provide the preferred resistance to curling. It has been determined that this curl resistance can be improved by increasing the percentage of polypropylene significantly thereby giving rise to slightly greater heat shrinkage but surprisingly without the occurrence of unreasonable levels of cupping.

OBJECTS AND SUMMARY

In view of the foregoing, it is a general object of the present invention to provide a carpet structure which includes a backing material of improved mechanical and thermal stability to eliminate curling and to impart controlled cupping of the carpet tile.

It is a related object to provide a carpet structure having a backing material which can be heat fused to produce a smooth contact surface for positioning on the floor or application of a peel-away or pre-applied pressure sensitive adhesive.

In accordance with these objects, it is a feature of the present invention to provide a carpet tile including a backing material formed from a nonwoven needlepunched fabric comprising a composite of polyester and at least 30 percent polypropylene which is fused to have a smooth surface.

In accordance with the above objects and features, a carpet tile is provided. The carpet tile of the present invention preferably incudes a primary carpet fabric having a plurality of pile-forming yarns projecting outwardly therefrom. A layer of reinforcement material such as glass scrim is preferably bonded to the underside of the primary carpet fabric. A cushion layer of polyurethane foam at least partially surrounds the layer of reinforcement material. A layer of heat fused nonwoven needlepunched backing material is disposed on the underside of the cushion layer. The backing layer preferably comprises polyester and polypropylene including at least 30 percent polypropylene and no more than 70 percent polyester.

BRIEF DESCRIPTION OF THE DRAWINGS

FIG. 1A is a cut-away view of a prior art tufted carpet with a cushioned composite structure.

FIG. 1B is a cut-away side view of a prior art bonded carpet incorporating a cushioned composite structure.

While the invention will be described and disclosed in connection with certain preferred embodiments and procedures, it is by no means intended to limit the invention to such specific embodiments and procedures. Rather it is intended to cover all such alternative embodiments, procedures, and modifications thereto as may fall within the true spirit and scope of the invention as defined and limited only by the appended claims.

DETAILED DESCRIPTION

Figure 2:
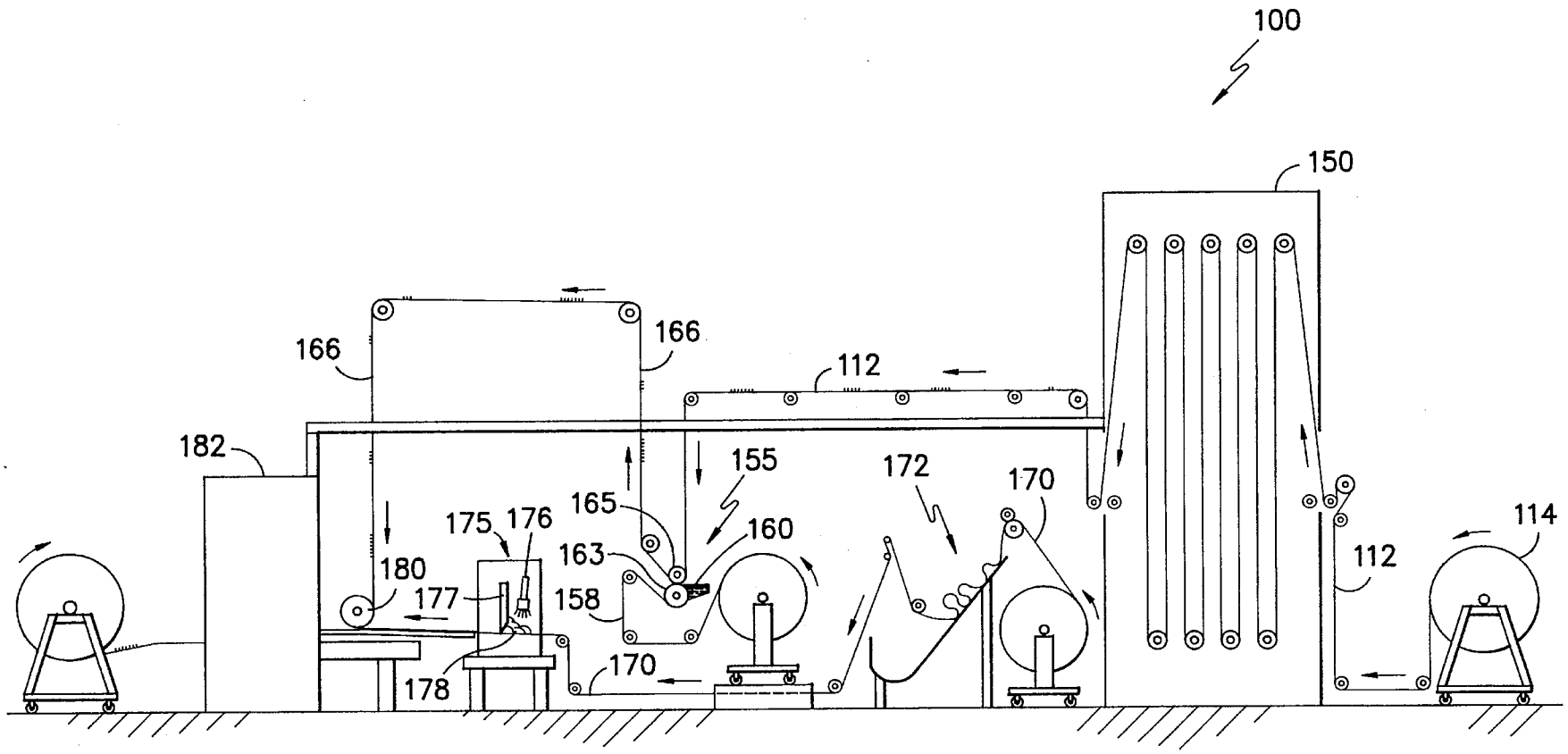
FIG. 2 is a schematic view illustrating a potentially preferred embodiment of the apparatus and process for forming the carpet of the present invention.

A schematic view illustrating a potentially preferred apparatus and process used in forming the cushioned carpet of the present invention is illustrated in FIG. 2. The apparatus is designated generally by reference numeral 100. As illustrated, a primary carpet fabric 112 which may incorporate either a tufted or a bonded configuration as described above is drawn from a mounted carpet roll 114. As indicated previously, the primary carpet fabric 112 preferably includes a plurality of pile-forming yarns projecting outwardly from one side of a primary base. If the primary carpet 112 used in the present invention is a tufted carpet, its configuration will preferably conform to that of the primary carpet 12 illustrated in regard to the prior art in FIG. 1A, while if the primary carpet 112 used in the present invention is a bonded product, its configuration will preferably be that of the primary carpet 12 illustrated in FIG. 1B.

Alternative embodiments including those disclosed in U.S. Pat. No. 4,576,665 to Machell (incorporated by reference) may likewise be utilized. For example, it is contemplated that specialized primary backings such as nonwoven structures comprising fiberglass sandwiched between layers of polyester may be utilized in the primary tufted carpet to impart the desired properties relating to stability thereby potentially reducing or even eliminating the need for the latex pre-coat presently utilized. Moreover, it is contemplated that if a precoat is to be utilized, it may be added directly in-line in an operation prior to any adhesive operation.

Figure 3A:
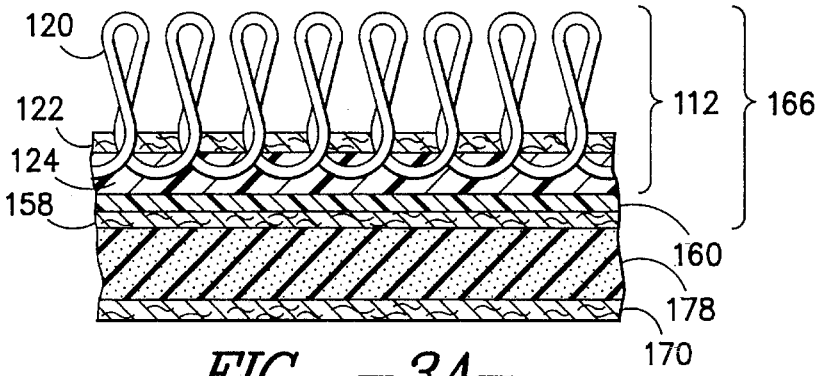
FIG. 3A is a cut-away side view of a tufted carpet incorporating a potentially preferred structure formed by the apparatus and process of the present invention as illustrated in FIG. 2.

With regard to the presently preferred embodiment, in the tufted carpet of the present invention (FIG. 3A), the primary carpet fabric 112 preferably comprises a loop pile layer 120 of pile-forming yarns tufted into a primary backing 122 as is well known and held in place by a precoat of latex or a hot melt adhesive 124. It is contemplated that the latex or hot melt adhesive may be added in-line after removal from the carpet roll prior to the application of any other adhesive as described below. The carpet may be steamed after addition of the precoat to facilitate subsequent printing operations if desired to reduce stresses.

Figure 3B:
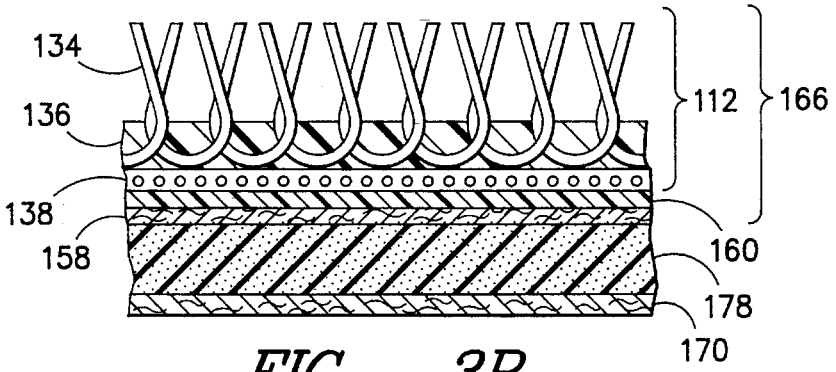
FIG. 3B is a cut-away side view of a bonded carpet incorporating a potentially preferred structure formed by the apparatus and process of the present invention as illustrated in FIG. 2.

In the bonded carpet of the present invention (FIG. 3B), the primary carpet fabric 112 preferably comprises a plurality of cut pile yarns 134 implanted in a latex or hot melt adhesive 136 which is laminated to a reinforcement or substrate layer 138 of a woven or nonwoven material including fiberglass, nylon, polyester or polypropylene. It is contemplated that this substrate layer 138 may be precoated with latex or other thermoplastic polymers to permit melting adhesion with the cut pile yarns 134 upon the application of heat, thereby potentially reducing or eliminating the need for the latex or hot melt adhesive 136.

The yarns 120, 134 may be either spun or filament yarns and are preferably formed from a polyamide polymer such as nylon 6 or nylon 6,6 available from DuPont Fibers in Wilmington, Del., although other suitable natural or synthetic yarns may likewise be employed as will be recognized by those of skill in the art. By way of example only and not limitation, other materials which might be used include polyesters such as polyethylene terephthalate (PET), and polybutylene terephthalate (PBT); polyolefins, such as polyethylene and polypropylene; rayon; and polyvinyl polymers such as polyacrylonitrile.

In the tufted product, the adhesive pre-coat 124 is preferably SBR latex but other suitable materials such as PVC, EVA, acrylic, and hot melt adhesives as are well known to those of skill in the art may likewise be utilized. In the event that a hot melt adhesive is utilized, it is contemplated that a reinforcement material such as a glass scrim could be directly attached to form a composite laminate without the use of adhesives. Moreover, as previously indicated, it is contemplated that the adhesive pre-coat 124 may be entirely eliminated in the tufted product if the loop pile 120 is tufted in suitably stable relation to the primary backing 122.

Referring again to FIG. 2, in the potentially preferred practice the primary carpet fabric 112 is conveyed by means of a plurality of rolls through an accumulator 150 as is well known in the art to a reinforcement bonding unit 155. Simultaneously with the conveyance of the primary carpet fabric 112 to the reinforcement bonding unit 155, a sheet of reinforcement material 158 is likewise conveyed to the reinforcement bonding unit 155. The reinforcement material 158 is preferably fiberglass nonwoven material although alternative materials may include woven glass, woven polyester, nonwoven glass, and nonwoven polyester.

At the reinforcement bonding unit 155, an adhesive 160 (FIGS. 3A, 3B) such as a hot melt adhesive is preferably applied to the reinforcement material 158 by means of a film coater or other such unit as are well known. The reinforcement material 158 and the primary carpet fabric 112 are thereafter preferably passed in mating relation between joining members such as rolls 163, 165, thereby bonding the reinforcement material 158 to the underside of the primary carpet fabric 112. That is, the reinforcement material 158 is bonded on the side of the primary carpet fabric 112 from which the pile forming yarns do not project. The bonding of the reinforcement material 158 to the underside of the primary carpet fabric produces a preliminary composite 166 which is thereafter laid into a puddle of a polyurethane-forming composition as described below.

Although the reinforcement bonding unit 155 is illustrated in its preferred embodiment as incorporating a film coater, it is to be understood that alternative equivalent means such as application rolls, spray headers and the like may also be utilized. By way of example only, and not limitation alternative means for the application of adhesive 160 are disclosed in U.S. Pat. No. 4,576,665 to Machell.

In the preferred practice, while the preliminary composite 166 is being formed, a backing material 170 is passed through a scray 172 to a polymer application unit 175 which preferably includes a polymer discharge unit 176 and a doctor blade 177. The backing material 170 is coated with a polymer 178 such as a polyurethane-forming composition.

The backing material 170 is preferably a needlepunched nonwoven material which has undergone a heat treatment to impart a smooth surface finish. The backing material comprises between about 30 percent and about 70 percent polypropylene and between about 70 percent and about 30 percent polyester. In the more preferred embodiment, the level of polypropylene will be between about 40 and about 60 percent and the level of polyester will be between about 60 and about 40 percent. In the most preferred embodiment, the backing material consists essentially of about 50 percent polypropylene and about 50 percent polyester wherein all percentages are by weight. Accordingly, the ratio of polyester to polypropylene may vary between about 2.3 (70 percent polyester and 30 percent polypropylene) and about 0.43 (30 percent polyester and 70 percent polypropylene although a ratio of 1:1 may be preferred. Such materials are believed to be available from Spartan Mills Company in Spartanburg, S.C. The thickness of the backing material 170 can vary in the range of from about 0.03 inches to about 0.07 inches, although a thickness of about 0.05 inches may be preferred.

Prior to the present invention it was believed that heat shrinkage stability and mechanical stability as may be necessary to avoid undesirable levels of cupping and curling of a carpet tile product required a nonwoven backing material of polyester and polypropylene to have at least 80 percent polyester contained therein. While such compositions proved generally useful in imparting the desirable properties, this composition nonetheless was found to yield some curling under extreme processing conditions. Moreover, it has been determined that it is somewhat difficult to impart a smooth surface to these materials during processing. As will be appreciated, a smooth underlying surface may be of benefit if the carpet tiles are to be maneuvered into position across a flooring surface or if a peel-away or pre-applied adhesive is to be applied to the underside of tile.

The present invention has solved these problems by using a nonwoven backing material having a much lower level of polyester than was previously thought to be necessary while at the same time increasing the level of polypropylene to levels which will slightly increase heat shrinkage (thereby eliminating curling) while facilitating the formation of a smooth underside by means of heat-fusion of the extending fibers in the backing material. Specifically, it has been determined that by maintaining the level of both polyester and polypropylene in a nonwoven material in the range of between about 30 and about 70 percent by weight, desired features of surface smoothness can be achieved while at the same time eliminating curling without adverse cupping of the product.

As indicated, in the preferred practice the polymer application unit 175 applies a deposit of a polymer 178 (FIGS. 3A, 3B) to the backing material 170 after which the height of the polymer is doctored to a desired level. In the preferred practice, the polymer applied is a polyurethane-forming composition based on a so called soft segment prepolymer of MDI (diphenylmethane diisocyanate) or an MDI derivative. The polyurethane-forming composition also preferably incorporates a silicone surfactant to improve both the frothability and stability of the polyurethane layer or "puddle" which is spread across the surface of the backing material 170.

As previously indicated, after disposition of the polymer across the backing material 170 the layer or "puddle" of polymer deposited is preferably doctored to a pre-determined height by means of a doctor blade located at the polymer application unit 175. While a simple mechanical doctor blade is preferred, alternative equivalent means such as an air knife or the like may also be used. Such an air knife is disclosed, for example, in U.S. Pat. No. 4,512,831 to Tillotson (incorporated by reference).

The primary carpet fabric 112 which is preferably joined to reinforcement material 158 to form the preliminary composite 166 can be laid directly into the polyurethane-forming composition immediately after it is doctored to the appropriate level. Accordingly, the preliminary composite 166 and the backing material 170 with the applied polyurethane-forming composition may be simultaneously delivered to a mating roll 180 immediately following the application and doctoring of the polyurethane-forming composition. In the preferred process, the preliminary composite 166 may be slightly preheated to improve operating control during lamination and curing but such preheat is not essential to formation of the desired product.

In the illustrated and preferred embodiment of the carpet, the process described above results in the layer of reinforcement material 158 being laid adjacent to and at least partially embedded in the layer of polyurethane 178. That is, the reinforcement material 158 is preferably in intimate contact with the polyurethane 178 such that the polymer material will hold the reinforcement in place.

Once the preliminary composite 166 has been laid into the polyurethane-forming composition, the resulting composite may be heated in a heating unit 182 by means of conduction, radiant, or convection heaters as are well known in the art. Contact conduction heaters may be preferred. Such heating may be carried out at a temperature of between about 250° F. and about 325° F. for between about 2 minutes and 8 minutes. The resulting foam cushion layer (FIGS. 3A, 3B) which is produced thereby preferably has a density of between about 12 pounds per cubic foot and about 20 pounds per cubit foot and more preferably between about 14 pounds per cubic foot and about 16 pounds per cubic foot.

The carpet composite which is formed will thereafter preferably be cut into carpet tiles either before or after any desired patterning operation takes place.

Figure 4A:
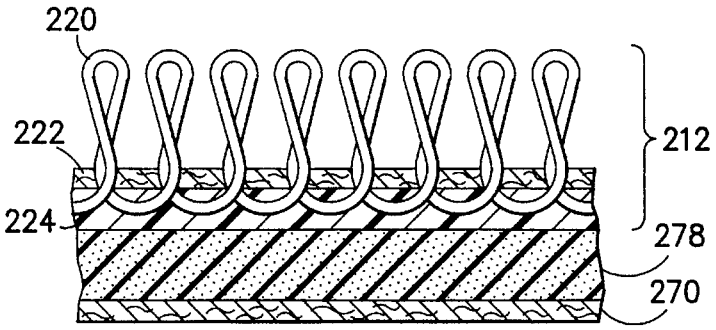
FIG. 4A is a cut-away side view of an alternative embodiment of a tufted carpet having no reinforcement layer.
Figure 4B:
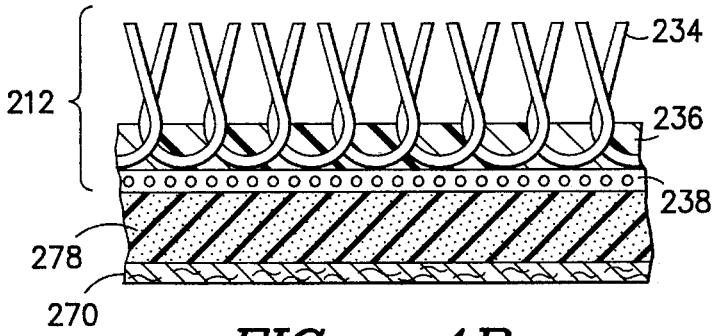
FIG. 4B is a cut-away side view of an alternative embodiment of a bonded carpet having no reinforcement layer.

It will be appreciated that a number of alternative practices may be incorporated into the present invention yielding slightly different products. By way of example only, the reinforcement material 158 may be left completely out of the process thereby making the use of the adhesive application apparatus 155 and adhesive 160 completely unnecessary. In such instances, the primary carpet fabric may be laid directly into the polyurethane-forming composition thereby yielding a composite structure as illustrated in FIGS. 4A and 4B with the polyurethane 278 immediately adjacent to the primary carpet fabric 212.

In yet another potential alternative, the backing 170, 270 may have an adhesive quick-release backing attached to the face to which the polyurethane-forming composition is not applied. As will be appreciated, such a quick release backing will permit the carpet to be readily installed and removed without damaging the polyurethane cushion 178, 278. Moreover, it is contemplated that in some instances the backing 170, 270 might be completely eliminated such that the polyurethane cushion 178, 278 would directly contact the flooring.

It is, of course, to be appreciated that while several potentially preferred embodiments have been shown and described, the invention is in no way to be limited thereto, since modifications may be made and other embodiments of the principles of this invention will occur to those skilled in the art to which this invention pertains. Therefore, it is contemplated by the appended claims to cover any such modifications and other embodiments as incorporate the features of this invention within the true spirit and scope thereof.

What is claimed is:

1. A carpet tile, comprising:

a primary carpet fabric having a plurality of pile-forming yarns projecting outwardly therefrom;

a mass of foamed polymer cushioning disposed on a side of said primary carpet fabric away from said plurality of pile-forming yarns; and a nonwoven backing comprising a heat-fused composite of polyester and polypropylene wherein the ratio of polyester to polypropylene is between about 0.43 and about 2.3.

2. The invention as in claim 1, wherein the ratio of polyester to polypropylene is between about 0.67 and about 1.5.

3. The invention as in claim 1, wherein the nonwoven backing consists essentially of about 50 percent polypropylene and about 50 percent polyester.

4. The invention as in claim 1, further including a layer of reinforcement material bonded to the underside of said primary carpet fabric.

5. The invention as in claim 4, wherein said reinforcement material comprises nonwoven fiberglass.

6. A carpet tile, comprising:

a primary carpet fabric having a plurality of pile-forming yarns projecting outwardly therefrom;

a mass of foamed polymer cushioning disposed on a side of said primary carpet fabric away from said plurality of pile forming yarns; and a nonwoven backing layer in direct contacting relation with said mass of polymer cushioning, said nonwoven backing layer comprising a heat fused composite of polyester and polypropylene wherein the ratio of polyester to polypropylene in the nonwoven backing layer is between about 0.43 and about 2.3.

7. The invention as in claim 6, wherein the ratio of polyester to polypropylene in the nonwoven backing layer is between about 0.67 and about 1.5.

8. The invention as in claim 6, wherein the nonwoven backing layer consists essentially of about 50 percent polypropylene and about 50 percent polyester.

9. The invention as in claim 6, further including a layer of reinforcement material bonded to the underside of said primary carpet fabric.

10. The invention as in claim 9, wherein said reinforcement material comprises nonwoven fiberglass.

11. A carpet tile, comprising:

a primary carpet fabric having a plurality of pile-forming yarns projecting outwardly therefrom;

a mass of heat cured foamed polyurethane cushioning disposed on a side of said primary carpet fabric away from said plurality of pile forming yarns; and a nonwoven backing layer in direct contacting relation with said mass of polyurethane cushioning, said nonwoven backing layer comprising a heat fused composite of polyester and polypropylene wherein the ratio of polyester to polypropylene in the nonwoven backing layer is between about 0.43 and about 2.3.

12. The invention as in claim 11, wherein the ratio of polyester to polypropylene in the nonwoven backing layer is between about 0.67 and about 1.5.

13. The invention as in claim 11, wherein the nonwoven backing layer consists essentially of about 50 percent polypropylene and about 50 percent polyester.

14. The invention as in claim 11, further including a layer of reinforcement material bonded to the underside of said primary carpet fabric.

* * * * *